US006877950B2

(12) United States Patent
Liu

(10) Patent No.: US 6,877,950 B2
(45) Date of Patent: Apr. 12, 2005

(54) METHOD AND DEVICE FOR MINIMIZING OIL CONSUMPTION IN A GAS TURBINE ENGINE

(75) Inventor: Xiaoliu Liu, Mississauga (CA)

(73) Assignee: Pratt & Whitney Canada Corp., Quebec (CA)

( * ) Notice: Subject to any disclaimer, the term of this patent is extended or adjusted under 35 U.S.C. 154(b) by 29 days.

(21) Appl. No.: 09/997,142

(22) Filed: Nov. 29, 2001

(65) Prior Publication Data

US 2003/0099538 A1 May 29, 2003

(51) Int. Cl.[7] ..... F01D 25/16
(52) U.S. Cl. ..... 415/111; 415/229; 277/400
(58) Field of Search ..... 415/111, 112, 415/113, 174.2, 174.5, 229, 231; 277/369, 384, 352, 377, 379, 390, 396, 400, 914

(56) References Cited

U.S. PATENT DOCUMENTS

| | | | | |
|---|---|---|---|---|
| 1,315,822 A | | 9/1919 | Doran | |
| 2,992,842 A | | 7/1961 | Shevchenko et al. | |
| 3,081,097 A | * | 3/1963 | Dison et al. | |
| 3,597,024 A | | 8/1971 | Singelmann | |
| 3,652,183 A | | 3/1972 | Pottharst, Jr. | |
| 3,915,521 A | | 10/1975 | Young | |
| 3,921,986 A | | 11/1975 | Geary et al. | |
| 4,157,834 A | * | 6/1979 | Burdette | |
| 4,333,659 A | | 6/1982 | Gibbs | |
| 4,531,358 A | * | 7/1985 | Smith | 60/39.08 |
| 5,174,584 A | | 12/1992 | Lahrman | |
| 5,301,957 A | | 4/1994 | Hwang et al. | |
| 5,415,478 A | * | 5/1995 | Matthews et al. | 384/476 |
| 5,464,227 A | | 11/1995 | Olson | |
| 5,582,413 A | | 12/1996 | Lendway | |
| RE35,909 E | | 9/1998 | Fondelius | |
| 5,813,830 A | | 9/1998 | Smith et al. | |
| 5,941,532 A | | 8/1999 | Flaherty et al. | |
| 6,142,729 A | | 11/2000 | Tran et al. | 415/113 |
| 6,257,589 B1 | | 7/2001 | Flaherty et al. | |

* cited by examiner

*Primary Examiner*—Edward K. Look
*Assistant Examiner*—Richard A. Edgar
(74) *Attorney, Agent, or Firm*—Ogilvy Renault

(57) ABSTRACT

A method of minimizing oil consumption in a gas turbine engine, by avoiding reliance on air intake into the engine oil circuit for bearing chamber oil sealing purposes. The engine oil circuit has bearing chambers with hydropad seals between the shaft and bearing chamber. During engine operation the ring rotates to cast oil radially outwardly from the shaft axis toward the outer periphery of the bearing chamber under centrifugal force, independent of any gas pressure differential across the sealing surfaces of the hydropad seal.

5 Claims, 4 Drawing Sheets

METHOD AND DEVICE FOR MINIMIZING OIL CONSUMPTION IN A GAS TURBINE ENGINE

TECHNICAL FIELD

The invention relates to a method of minimizing or completely reducing oil consumption in a gas turbine engine, and an engine designed according to the method, by avoiding the traditional reliance on air intake into the bearing chambers for preventing oil leakage.

BACKGROUND OF THE ART

The invention provides a method of minimizing oil consumption in a gas turbine engine. In general, oil is consumed as a consequence of air flow into the engine oil circuit to create a vacuum condition in the bearing oil chambers, thus preventing oil leakage into the compressed air and gas path of the engine. Since air is drawn into the bearing chambers to oppose oil leakage flow and the air mixes with the oil, an oil-air separator is necessary to reconstitute the oil and exhaust the air. Oil is consumed in that the air exhausted from the oil-air separator contains oil residue in an aerosol form. This conventional design inevitably consumes a portion of the oil which must be made up from oil supplies in the oil circuit. Oil aerosols have been the cause of increased level of engine emissions and staining of the engine nacelle surfaces.

A typical gas turbine engine includes an oil circuit that supplies cooling and lubricating oil to a number of bearings that support the engine shafts at longitudinally spaced apart supports along the shaft axis. The bearing chambers enclose the bearings and maintain a volume of oil with an oil-air interface in communication with the volume of oil enclosed within the bearing chamber. Within the bearing chambers, oil is supplied under pressure from an oil supply conduit and is sprayed at selected areas of bearing or is diffused through bearing surfaces. Oil flow simultaneously cools the bearings which develop heat under friction, lubricates the bearings, flushes out any foreign particles that develop and splashes within the bearing chamber to cool and lubricate internal surfaces before being withdrawn from the bearing chamber under the vacuum of a scavenge pump. Depending on the engine design, various oil circulation mechanisms are provided in flow communication with each bearing chamber for supplying a continuous flow of oil to the bearing chamber inlet and for evacuating or scavenging spent oil from an outlet of the bearing chamber.

As mentioned above, typically the bearing chambers of gas turbine engines utilize carbon seals or labyrinth seals that prevent escape of oil from the bearing chamber by creating a vacuum condition within the bearing chamber relative to the ambient engine conditions. Compressed air external to the bearing chamber is allowed to pass through the bearing chamber seals into the bearing chamber creating a flow of air that counteracts any tendency for the oil to escape. When the engine is at rest, the oil is maintained within the bearing chamber simply by friction between sealing faces of the prior art seals that are generally friction seals, carbon seals or labyrinth seals depending on the particular application. In all cases however, airflow across the sealing surfaces is provided to create a vacuum condition within the bearing chamber relative to ambient engine condition and provide an airflow across the sealing surface to prevent the escape of oil from the bearing chamber enclosing the oil lubricating and cooling the bearings.

Examples of prior art seals are shown in: U.S. Pat. No. 5,582,413 to Lendway that provides an oil seal for a gas turbine with radially grooved seal surface; U.S. Pat. No. 5,813,830 to Smith et al. showing a carbon seal contaminant barrier system for a gas turbine engine; and U.S. Pat. No. 5,174,584 to Lahrman for fluid bearing face seal for gas turbine engines with spring loaded sealing ring. Of particular interest to the present invention is the development of hydropad seals as shown for example in U.S. Pat. No. 6,257,581 B1 to Flaherty et al. for an aerospace housing and shaft assembly sealed with hydropad seals.

It is an object of the present invention to minimize or substantially reduce the consumption of oil in a gas turbine engine by avoiding reliance on air intake into the engine oil circuit bearing chambers for sealing purposes.

It is a further object of the invention to provide a method of substantially reducing oil consumption and resultant disadvantages of entraining air into the oil which is circulated through the engine including avoiding the need for an oil/air separator, reduction of oil loss through exhausted aerosols from the oil/air separator, reduction in pump size, reduction in heat input into the oil circuit, oil tank size and oil cooler size due to the volume reduction in the oil/air mixture.

Further objects of the invention will be apparent from review of the disclosure, drawings and description of the invention below.

DISCLOSURE OF THE INVENTION

The invention provides a method of minimizing oil consumption in a gas turbine engine, by avoiding reliance on air intake into the engine oil circuit bearing chamber for oil-sealing purposes. Typically a gas turbine engine has an oil supply circuit to cool and lubricate bearings supporting one or more engine shafts with bearing chambers enveloping the bearings and containing oil that is sprayed or splashed on the moving parts. Oil is circulated to and evacuated from the bearing chamber with an oil pressure pump, scavenge pump, oil filter, oil tank and is cooled within a heat exchanger. No oil-air separator is needed however since hydropad seals are used between the shaft and bearing chambers that do not rely no air intake flow to maintain an oil seal but rather rely on centrifugal casting of oil away from the sealing surfaces during rotation. Oil has a relatively high density and viscosity compared to air and therefore rotation of the seal casts oil radially outward preventing oil leakage. Reducion of air intake has several advantages including: reducion of oil-air mixing; elimination of air-oil separator and the resultant oil loss through exhausted aerosols; reduction in pump, oil tank and oil cooler size due to volume reduction.

To minimize, or optimally to completely eliminate, oil consumption in a gas turbine engine therefore all bearing cavities are fitted with hydropad seals. The hydropad seals do not merely reduce airflow but rather unlike conventional seals do not rely on air flow through the bearing cavity seals to prevent oil leakage. Hydropad seals are independant of air flow and may accomodate a positive, negative or zero pressure differential between the interior of the bearing cavity and the ambient engine area. The air flow through the hydropad seal can be positive, negative or zero, but in any case no oil will leak past the seal.

Oil is prevented from leaking past the hydropad seals due to the centrifugal force exerted on the relatively dense and viscous oil by the high speed rotation of the hydropad sealing ring. Since the air can enter the bearing cavity through some of the hydropad seals and then exit through other hydropad seals, the breather or oil/air separator can be eliminated entirely. Oil consumption is thereby reduced significantly or preferably eliminated altogether by avoiding the exhausting of aerosol oil/air mixtures from the oil/air separator. Further advantages include reduction in overall oil circuit system including reduction in pump sizes, oil tank size, and oil cooler size since the entrained air and its associated heat are reduced drastically.

Therefore the invention provides a method of minimizing oil consumption in a gas turbine engine, by avoiding reliance on air intake into the engine oil circuit for bearing chamber oil sealing purposes. The engine has an oil circuit with at least one bearing supporting at least one engine shaft at a support point along a shaft axis, at least one bearing chamber enveloping each bearing and maintaining a volume of oil with an oil-air interface in communication with a volume of air, and an oil circulation system in flow communication with each bearing chamber for supplying a flow of oil to a bearing chamber inlet and for evacuating spent oil from an outlet of the bearing chamber. The method involves sealing each bearing chamber with a hydropad seal between the shaft and bearing chamber. The hydropad seal having an annular ring mounted to the shaft and an annular pad mounted to the chamber, each having abutting seal surfaces. During engine operation the ring rotates to cast oil radially outwardly from the shaft axis toward the outer periphery of the bearing chamber under centrifugal force. Oil is then collected from the outer periphery of the bearing chamber and directed to the bearing chamber outlet.

The invention further provides a gas turbine engine that reduces air intake into the engine oil circuit for bearing chamber oil sealing purposes, the engine having an oil circuit including: at least one bearing supporting at least one engine shaft at a support point along a shaft axis; at least one bearing chamber enveloping each said bearing and maintaining a volume of oil with an oil-air interface in communication with a volume of air therein; and oil circulation means in flow communication with each bearing chamber for supplying a flow of oil to a bearing chamber inlet and for evacuating spent oil from an outlet of the bearing chamber; characterized in that, the engine comprises: a hydropad seal disposed in sealing relation between the shaft and a bearing chamber, the hydropad seal comprising an annular ring mounted to the shaft and an annular pad mounted to the chamber, the ring and pad having abutting seal surfaces; turbine means mounted to the shaft for rotating the ring during engine operation to cast oil radially outwardly from said shaft axis toward an outer periphery of the bearing chamber under centrifugal force; and wherein the oil circulation means includes oil scavenge means for collecting oil from the outer periphery of the bearing chamber and directing oil flow to the bearing chamber outlet.

DESCRIPTION OF THE DRAWINGS

In order that the invention may be readily understood, one embodiment of the invention is illustrated by way of example in the accompanying drawings.

Further details of the invention and its advantages will be apparent from the detailed description included below.

DETAILED DESCRIPTION OF PREFERRED EMBODIMENTS

Figure 1:
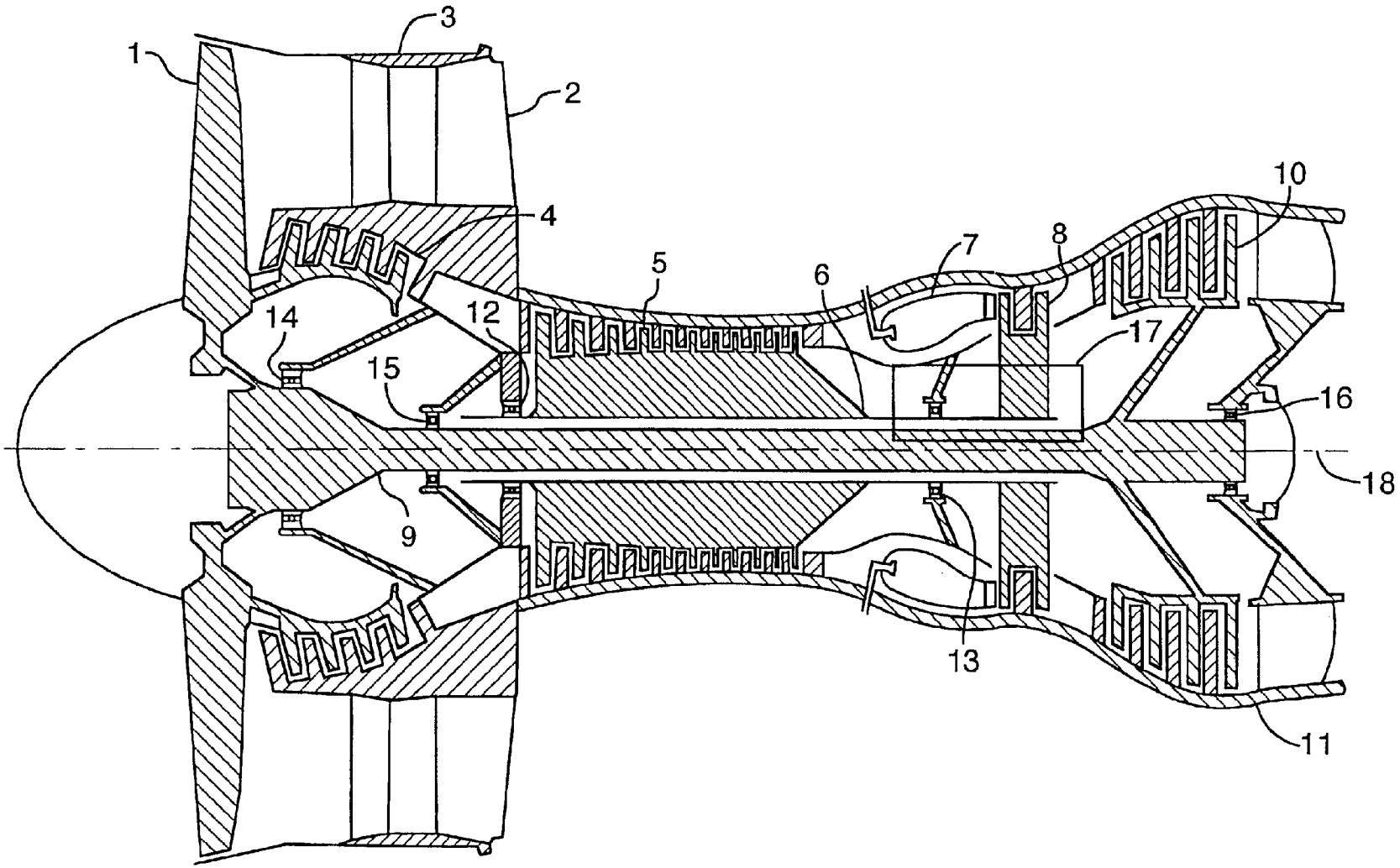
FIG. 1 is a longitudinal cross-sectional view through one example of a gas turbine engine showing coaxial low pressure and high pressure shafts, and showing the typical locations of the various supporting bearings.

FIG. 1 shows a longitudinal cross-sectional view through an example gas turbine engine. Air passes through the engine (from left to right as drawn) first passing fan 1 and then splitting into two flows of air. An outer portion of the air flow passes through the bypass duct 2 formed by the annular fan case 3 and an inner portion passes through the engine core past low pressure compressor blade 4. In the example shown, the engine includes an axial high pressure compressor 5 mounted to a high pressure shaft 6 and driven by hot gas passing from combustor 7 over high pressure turbine rotors 8. The fan 1 and low pressure compressor 4 are mounted to a low pressure shaft 9 driven by low pressure turbine rotors 10. As seen in FIG. 1, the high pressure shaft 6 is supported on forward bearings 12 and rearward bearings 13. In a like manner, the low pressure shaft 9 is supported on three bearings 14, 15 and 16.

Of particular interest to the present invention are the bearing cavities which surround all bearings to mount the shafts 6 and 9 to the engine casing 11 and prevent oil leakage into the air flow through the engine.

Figure 2:
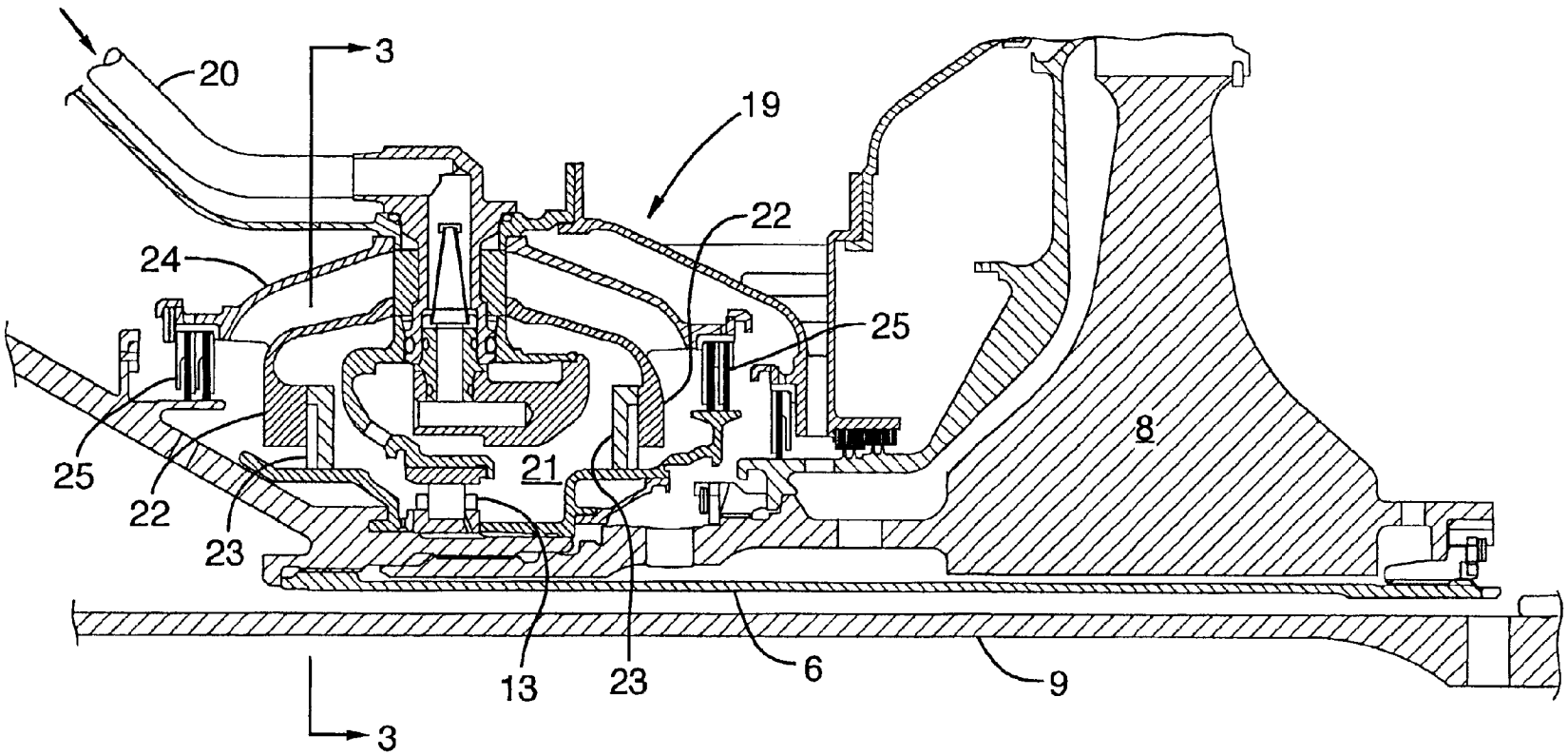
FIG. 2 is a detailed axial cross-sectional view through a bearing cavity located immediately upstream of a high pressure turbine rotor.

The detailed view of FIG. 2 shows a single bearing 13 indicated by detail segment 17 of FIG. 1. It will be understood however that all bearings 14, 15, 16, 12 and 13 are enclosed in bearing cavities and are supplied by the oil supply system of the engine with pressurised oil.

Figure 4:
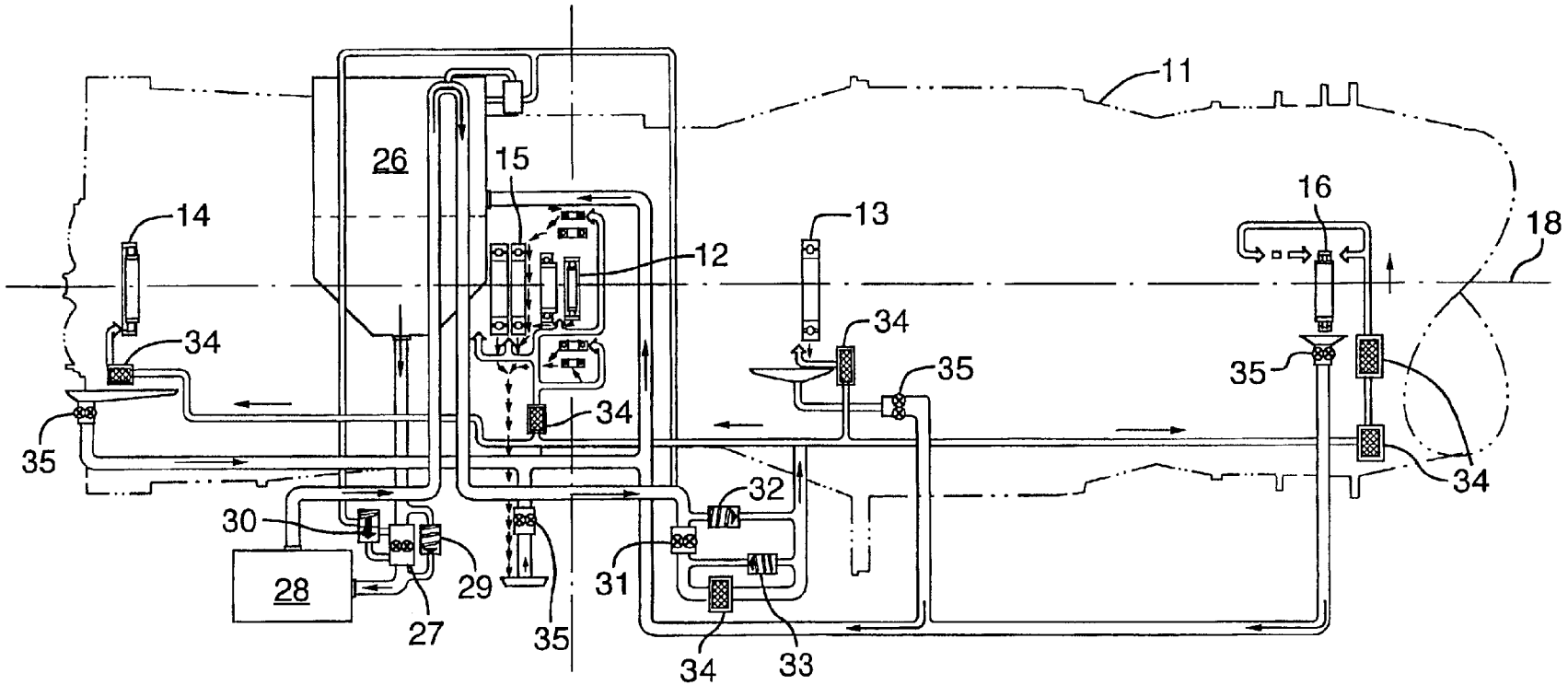
FIG. 4 is a schematic view of a typical oil supply and circulation circuit through the gas turbine engine of FIG. 1.

FIG. 4 shows a schematic view of the entire oil circuit for the gas turbine engine. As mentioned above, bearings 14, 15 and 16 support the low pressure shaft 9 whereas bearings 12 and 13 support the high pressure shaft for rotation about the central shaft axis 18 of the engine. As shown in the example of FIG. 2, each bearing is enveloped by a bearing chamber 19 within which is maintained a volume of oil with an oil air interface in communication with the air inside the chamber 19. The oil supply conduit 20 provides oil under pressure to the interior housing 21 within which the bearings 13 rotate.

Oil is prevented from leaking with hydropad seals comprising a stationary annular pad 22 and a rotating ring 23 each having abutting seal surfaces to prevent leakage of oil. Around the interior housing 21 is an air filled plenum 24 that serves to cool the outer surface of the housing 21 with compressed air from the cooler low pressure section 4 of the compressor and is sealed with running seals 25. Air is circulated to and exhausted from the plenum 24 with inlet and outlet conduits (not shown). The oil provided via conduit 20 to the interior housing 21 is withdrawn through oil scoops and the oil conduit (not shown) to a scavenge pump 35.

With reference to the schematic view of FIG. 4, therefore each bearing 14, 15, 12, 13 and 16 is surrounded by a similar bearing chamber 19 (which for clarity has not been shown in FIG. 4 but is schematically suggested by the collecting tray under the bearings). Commencing at oil tank 26, oil begins circulation through the oil boost pump 27 and is conducted through the oil cooler 28 (or heat exchanger). A relief valve 29 and a regulating valve 30 control the operation of the pump 27. Oil passing from the cooler 28 proceeds to the oil pressure pump 31 where pressure is increased to the level required for distribution to each bearing chamber 19. Operation of the oil pressure pump 31 is augmented by a pressure regulating valve 32 and a main screen bypass valve 33.

Oil passes through filters or screen 34 and progresses for distribution to each of the bearings 12–16. Oil is sprayed under pressure and injected into the bearings 12–16. Spent oil is collected within the bearing chambers and drawn away with scavenge pumps 35 for return via conduits to the oil tank 26.

Therefore, the oil circuit of the gas turbine engine includes a number of bearings 12 through 16 supporting engine shafts 6 and 9 at longitudinally spaced apart support points along the shaft axis 18. Each bearing 12 to 16 is enveloped by a bearing chamber 19 and a volume of oil is maintained within the chamber with an oil air interfacing communication with the air housed within the bearing chamber. Oil is supplied to the bearing chamber to an inlet and evacuated through an outlet thereby cooling and lubricating the bearings 12–16.

Figure 3:
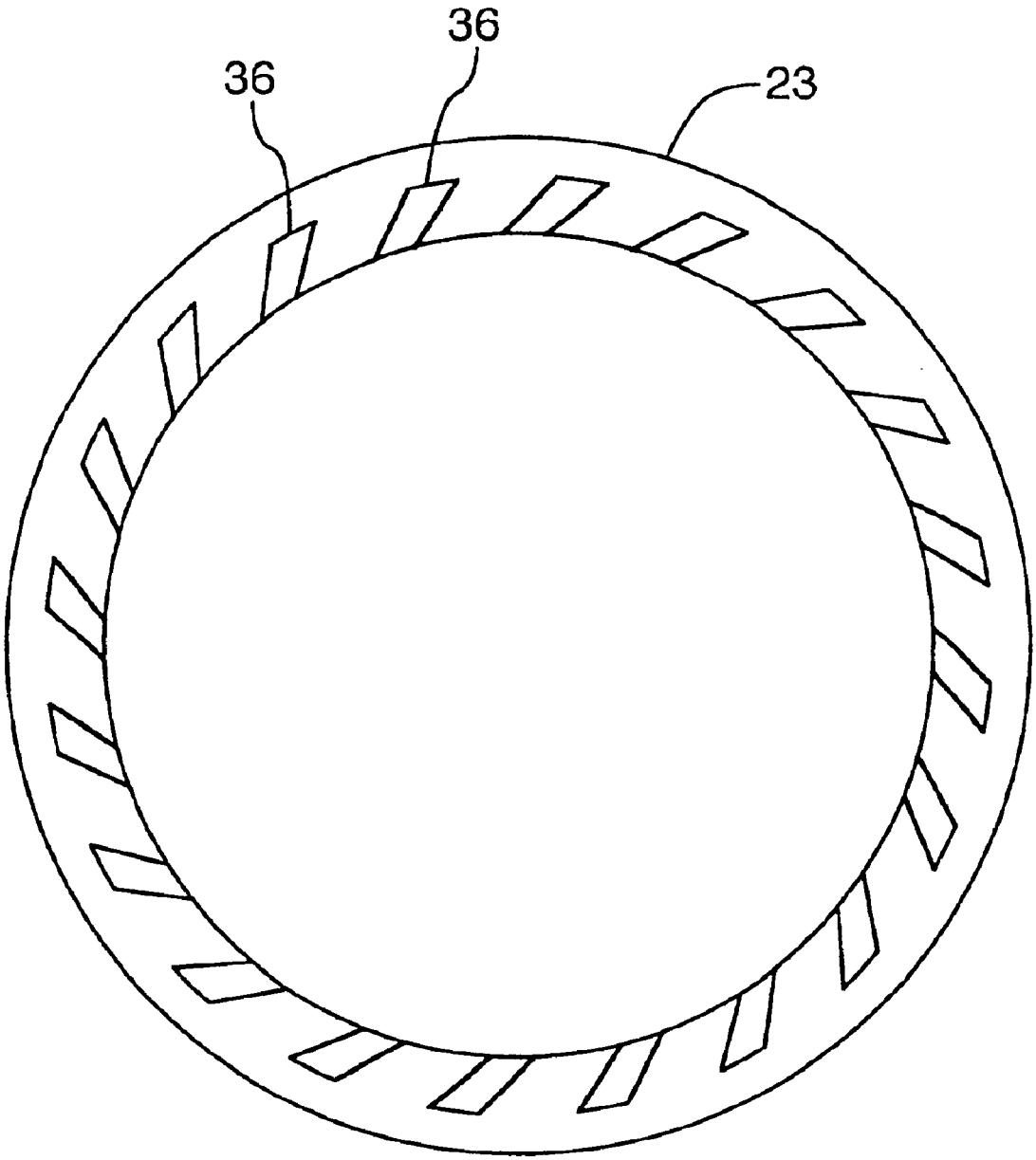
FIG. 3 is a cross-sectional view along lines 3—3 of FIG. 2 showing the sealing surface of a hydropad ring for casting oil outwardly under centrifugal force and impeding oil passage through the hydropad seal.

Each bearing chamber 19 is sealed with hydropad seals between the shaft 6, 9 and bearing chambers 19. As indicated in FIGS. 2 and 3, each hydropad seal comprises an annular ring 23 mounted to the shaft 6 and an annular pad 22 mounted to the chamber 19. The ring 23 and the pad 22 have abutting sealing surfaces in a radial plane in the embodiment illustrated. At rest or at low speeds of rotation, the inherent friction between the pad 22 and ring 23 is sufficient to prevent leakage of oil. However as indicated in FIG. 3, the ring 23 includes recesses 36 that serve as impellers to pump air and during high speed rotation that create an air curtain that serves to lift the contacting seal surfaces of the ring 23 from the pad 22 on a compressed air layer. Rotating the ring 23 during engine operation casts oil radially outwardly from the shaft axis 18 under centrifugal force. Oil is collected from the outer periphery of the inner housing 21 of the bearing chamber 19 and is directed toward the bearing chamber outlet to be evacuated and returned to the system via the scavenge pumps 35.

A significant advantage of the use of hydropad seals is that pressure differential across abutting seal surfaces of the hydropad seal can be negative, positive or zero. In a negative condition there is a relative vacuum within the bearing chamber whereas in a positive condition the relative vacuum is outward of the bearing chamber. At zero pressure differential the pressure is substantially equal inside and outside of the bearing chamber. In all cases, the pressure differential does not effect the circumferential casting of oil radially outward from the shaft axis since the relative density and viscosity of the oil is high compared to air. As a result the method of the invention does not require passage of air to prevent oil from escaping from the bearing chamber.

Use of hydropad seals therefore enables the oil circulation system to operate independently of any oil/air separation function or any air venting function unlike prior art systems. As mentioned above, in the prior art, air is drawn into each of the bearing chambers in order to prevent oil leakage. Such air drawn into bearing chamber is mixed with oil and evacuated with scavenge pumps. In order to separate the air and oil however, an oil-air separator is required which vents excess air over board along with inevitable amount of oil aerosol. In this way, prior art systems consume oil.

In contrast, the present method does not require air to be drawn into the bearing chambers 19 but rather operates independently of airflow across the hydropad sealing surfaces. Oil is prevented from escaping the bearing chambers 19 by the rotation of the hydropad ring 23 which casts oil of higher density than air towards the radial outward portion of the bearing chamber 19 thus preventing oil leakage. When rotation of the shaft 6 ceases or is a relatively low speed the ring 23 and pad 22 engage in frictional sealing contact to prevent leakage. At high speed however the pad 22 and ring 23 separate and ride on an air cushion created by recesses 36 which pump compressed air between the sealing surfaces. At high rotation, the centrifugal force prevents oil from escaping radially inwardly across the sealing surfaces between pad 22 and ring 23. At the outer periphery of the bearing chamber 19 an oil scoop is disposed to provide an inlet to the scavenge pumps 35 and prevent oil from unnecessarily circulating within the bearing chamber 19.

Although the above description relates to a specific preferred embodiment as presently contemplated by the inventor, it will be understood that the invention in its broad aspect includes mechanical and functional equivalents of the elements described herein.

I claim:

1. A breather-less oil system for a gas turbine engine comprising:

an oil system adapted to supply pressurized oil to and evacuate oil from a plurality of bearing chambers, the bearing chambers each having at least one oiled bearing therein supporting a rotatable component and at least one air-oil interface defined between a volume of oil within the chamber and a volume of air outside the chamber; and a plurality of hydropad seals, wherein all of said air-oil interfaces are sealed by hydropad seals such that in use the hydropad seals permit air to enter and to exit the oil system, thereby permitting the oil system to be operated independent of an air breather apparatus.

2. A method according to claim 1 wherein cast oil is collected from an outer periphery of the bearing chamber using an oil scavenge pump in communication with the bearing chamber.

3. A method according to claim 1 wherein oil circulates independently of an oil-air separation function and an air venting function.

4. A method according to claim 1 wherein abutting sealing surfaces of the hydropad remain engaged in frictional sealing relation below a lift off rotary speed.

5. A method according to claim 4 wherein the abutting sealing surfaces of the hydropad disengage when rotary speed exceeds the lift off rotary speed, a ring sealing surface casting oil outwardly under centrifugal force to impede oil passage through the hydropad seal.

* * * * *